United States Patent [19]

Yamaguchi

[11] 3,935,831

[45] Feb. 3, 1976

[54] MEANS OF CONNECTING A PUSHER BOAT AND A BARGE

[76] Inventor: Takuma Yamaguchi, No. 7-5203, 2 chome, Sodegaura, Narashino, Chiba, Japan

[22] Filed: Mar. 27, 1975

[21] Appl. No.: 562,588

[30] Foreign Application Priority Data

Apr. 15, 1974 Japan ..... 49-42638

[52] U.S. Cl. ..... 114/235 A

[51] Int. Cl.[2] ..... B63B 21/56

[58] Field of Search ..... 114/235 R, 235 A, 43.5, 114/77 R; 24/263 DH

[56] References Cited

UNITED STATES PATENTS 3,345,970 10/1967 De Long ..... 114/235 R 3,735,722 5/1973 Hooper et al. ..... 114/235 R

*Primary Examiner*—Trygve M. Blix

*Assistant Examiner*—Jesus D. Sotelo

*Attorney, Agent, or Firm*—Hans Berman

[57] ABSTRACT

Apparatus for connecting a pusher boat and a barge in which the bow of the pusher boat is received in a notch formed in the stern portion of the barge, and movable connecting pins mounted on both sides of the bow of the pusher boat are inserted into vertical channels formed within the notch so that convexities formed at the outer end portions of the connecting pins may engage concavities formed within the channels, thereby the pusher boat and the barge being easily and firmly connected.

6 Claims, 10 Drawing Figures

MEANS OF CONNECTING A PUSHER BOAT AND A BARGE

This invention relates to a means of connecting a pusher boat and a barge.

Barges are very widely used for the transportation of bulky freight on rivers, canals and lakes or in harbours. There are two conventional methods to move the barges, one being to tow by a tug boat and the other being to push by a pusher boat. The present invention relates to the latter case in which the barge is pushed by a pusher boat where said barge is connected with the pusher boat to form a pusher-barge combination system. More particularly, the invention relates to an improved pusher-barge combination system with excellent performance.

The method of connecting the pusher boat and the barge by means of ropes has widely been employed. In this method, however, the stern portion of the barge and the bow portion of the pusher boat come into contact with each other, and vertical relative sliding of said portions cannot be avoided. This relative sliding of two watercraft causes heavy wear and tear of the buffer means provided between them. Furthermore, when the positions of fixing ropes are not properly selected, the connecting ropes are often subject to undue and excessive tension owing to relative pitching and yawing motions between these two watercraft, and the difficulties of navigations in a heavy seaway by such rope-connected pusher-barge combination systems are principally due to the above-mentioned disadvantages.

Accordingly, the present invention is proposed in order to solve the above-mentioned problems, and its principal object is to provide an improved means of connecting a pusher boat and a barge in which the connecting work can be readily and easily carried out irrespective of the draft relationship between two watercraft, and any undue stress within the connecting means can be eliminated so as to prevent damages to its structural members.

Another object of the present invention is to propose additionally an improved connecting means in which undue influences of inevitable deformations and bad accuracy of the hull structure constructed by electric arc welding can be completely eliminated.

Pursuant to the above objects of the invention, the means of connecting a pusher boat and a barge is constructed as follows; that is, the stern portion of the barge is provided with a notch or well, into which the bow portion of the pusher boat can be received with some suitable clearance being left around said bow portion. Each side of said notch is provided with a vertical channel opened towards the notch and composed of a bottom wall and two side walls, the latter of which being placed adjacent to the opening or entrance of the channel and provided with horizontal concavities extending from the entrance of said notch to said bottom wall and stepwise arranged from top to bottom on said side walls in such a manner that two concavities provided at the same height on the opposite side walls may form a pair of concavities.

On the other hand, both sides of the bow portion of the pusher boat are provided with hydraulically operated connecting pins, respectively, which can rotate relative to said pusher boat. The outer free end of each of said connecting pins has two convexities, on the forward and after side of said connecting pin, so shaped as to automatically select and tightly engage with one of said pairs of concavities when said connecting pin is hydraulically extended and its outer free end is forcibly inserted into said channel. Thus, said two watercraft can be firmly connected by the engagement of said connecting pins and said vertical channels.

Furthermore, when the pusher boat and the barge are constructed by welding and they are so large that bad influences of inevitable geometrical inaccuracies such as deformations of structure and misalignment due to welding cannot be neglected, special care must be paid to the tight contact between said convexities of said connecting pins and the surfaces of said concavities of channels; otherwise damages may be expected due to enormous forces transmitted by these structural members of the connecting means. In such cases, the connecting pin is to have a spherical head, over which a helmet is tightly mounted in such a manner as to turn to any direction within a small range necessary in the practical applications. Said helment has two convexities similar to those on the connecting pin explained above, which are to engage with a pair of concavities when said connecting pin is hydraulically extended out. The spherical mounting of said helmet can accommodate said helmet to probable geometrical inaccuracies due to welding and realize a very firm and reliable connection without any undue stress arising in any portion of the means of connection.

Between the pusher boat and the barge connected with each other by thus constructed connecting means, there exists only relative pitching motion, and other relative motions such as rolling, yawing, heaving, drifting and surging are not permitted. Further, the displacement of the pusher boat is generally one tenth or less of the full load displacement of the barge, so that all motions of the pusher boat other than pitching thereof will follow the motions of the barge and, therefore, the overall motion of the pusher boat becomes gentle, and the operation and control of the pusher boat can be made much easy. Still further, the construction of the connecting means, more particularly, firm connection due to engagement of said convexities of the connecting pin or the helmet mounted thereon and said concavities stepwise arranged in the vertical channel can be readily formed in any draft relationship.

Other and further objects and features of the invention will become more apparent upon the understanding of the illustrative embodiments about to be described or will be indicated in the appended claims and various advantages not referred to herein will occur to one skilled in the art upon employment of the invention in practice. Two embodiments are shown in the drawings, in which same parts are indicated by same numerals. In the drawings:

Figure 1:
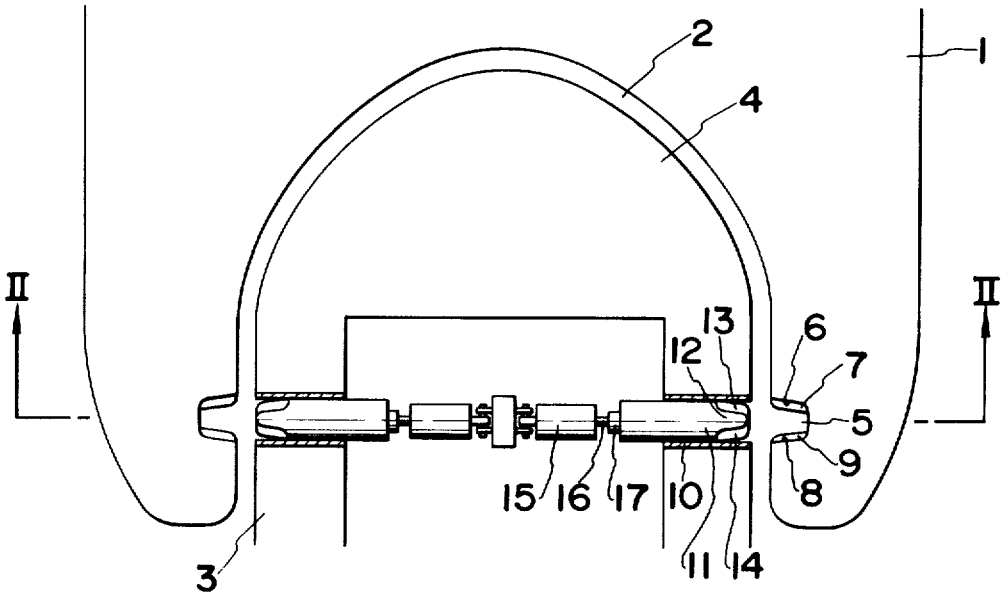
FIG. 1 is a schematic plan view of one embodiment of the present invention before connection.

Referring now to FIGS. 1 to 7 showing the first embodiment of the present invention, the barge 1 is provided with a notch or well 2 at its stern or rear portion for receiving the bow 4 of the pusher boat 3. The configuration and size of said notch 2 is such that, when the pusher boat 3 is connected to the barge 1, a proper clearance may be left between the bow 4 of the pusher boat 3 and said notch 2 of the barge 1. Each side of the inner wall of said notch 2 is provided with a vertically extending channel 5 opening towards the inside of the notch 2 and having preferably a trapezial cross-section consisting of two side walls 6 and 8 adjacent to the inner wall of said notch 2 and a bottom wall. Said two side walls 6 and 8 placed opposite to each other with the opening or entrance of said channel 5 in between have concavities 7, 7′, 7″, . . . and 9, 9′, 9″, . . . , respectively, which are horizontally extending from the entrance of said channel 5 to its bottom wall and stepwise arranged from top to bottom approximately at an equidistance apart in such a manner that each of the concavities on the side wall 6 may be at a same height as any of concavities on another side wall 8, so as to form a pair of concavities. For example, two concavities 7 and 9 are placed at a same height so as to form a pair. A pair of said channel 5 on both sides of the inner wall of the notch 2, having side walls 6 and 8 provided with series of concavities 7, 7′, 7″, . . . and 9, 9′, 9″, . . . , respectively, forms a tooth-engagement portion for receiving and fixing, at any vertical position, the outer ends of respective connecting pins extended from both sides of the bow 4 of the pusher boat 3, which will be explained further hereinafter.

Figure 4:
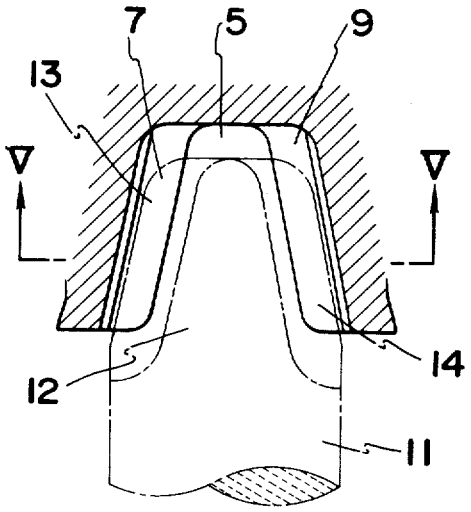
FIG. 4 is a horizontal sectional view showing the manner of engagement of the connecting pin and the channel of said embodiment.
Figure 5:
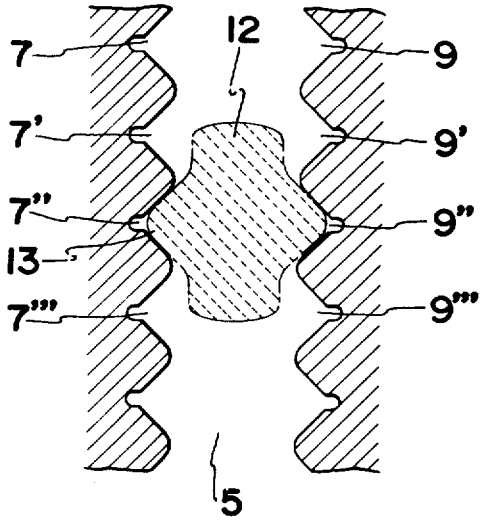
FIG. 5 is a vertical sectional view, taken along the line V — V in FIG. 4, showing the manner of engagement of the connecting pin with convexities and the channel with concavities of said embodiment.
Figure 6:
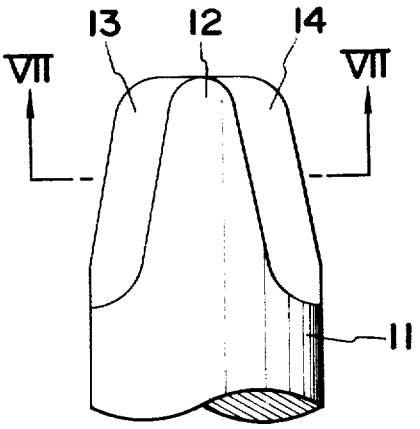
FIG. 6 is a schematic plan view of the outer end portion of said connecting pin of said embodiment.
Figure 7:
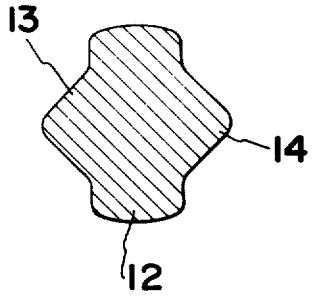
FIG. 7 is a vertical sectional view, taken along the line VII — VII in FIG. 6.

Each side of the bow 4 of the pusher boat 3 is provided with a cylindrical connecting pin 11 which is supported by and slides along a long bearing 10 transversely placed symmetrically with respect to the ship's centerline and fixed to the hull. The outboard end 12 of this connecting pin 11 is so shaped as to stop at a predetermined depth and come into tight contact with any of pairs of concavities 7 and 9, 7′ and 9′, etc., of the channel 5, when it is inserted into the channel 5. For example, when said channel 5 has a trapezial cross-section and each concavity has an isosceles triangular shape, as shown in FIGS. 4 and 5, the outboard end 12 of the connecting pin 11 has, on its forward and after sides, respectively, convexities 13 and 14 of isosceles triangular cross-section having an apex angle same as that of the concavities 7, 9, etc., and also is tapered towards the end of said connecting pin 11 to correspond to the trapezial cross-section of the channel 5. The outer ends of said convexities 13 and 14 are fairly tapered so as to easily enter into the concavities 7 and 9, 7′ and 9′, etc. Said connecting pin 11 can be forced out and retracted in by means of a hydraulic power means, such as hydraulic cylinder 15 or the like, and it can also be maintained, at the outermost position, under outward force kept by hydraulic pressure led from a pump, a pressure accumulator or the like (not indicated in Figures) through a pilot check valve (not indicated in Figures), which can prevent the connecting pin 11 being pushed back into the hull by enormous external forces.

Next, the functions and operations of the connecting means of the present invention explained in relation to the above embodiment will be disclosed.

Figure 2:
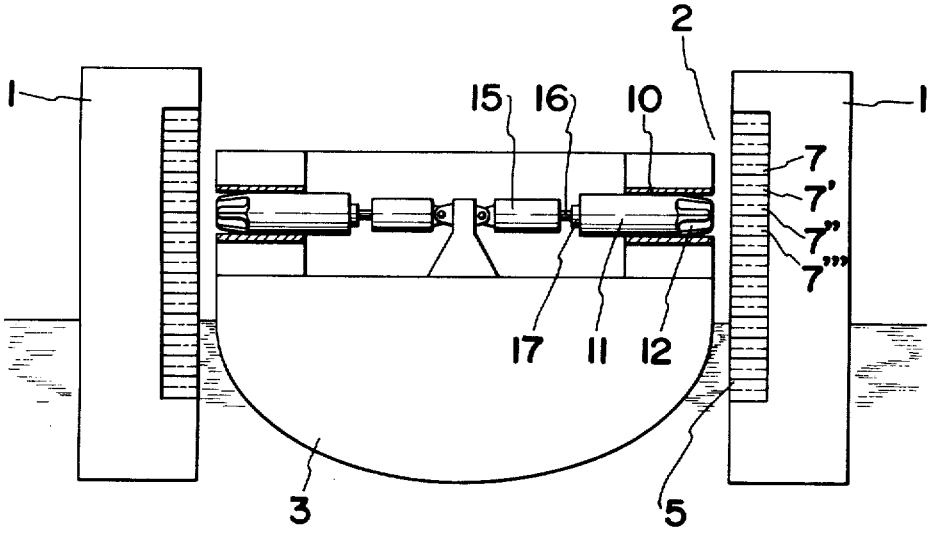
FIG. 2 is a vertical sectional view of the embodiment taken along the line II — II in FIG. 1.
Figure 3:
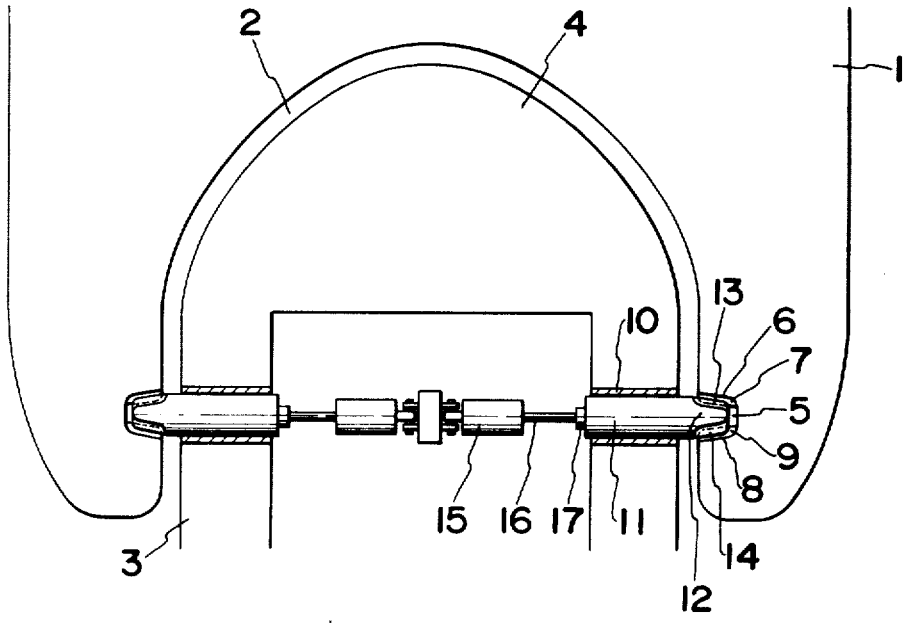
FIG. 3 is a plan view of said embodiment after connection.

Before the pusher boat 3 is connected to the barge 1, the connecting pin 11 contained in the bearing 10 is retracted into the hull of the pusher boat 3 as shown on FIGS. 1 and 2. In this position, the outer end portion 12 of the connecting pin 11 is entirely retracted into the hull of the pusher boat 3, so that the bow of the pusher boat 3 can be easily inserted into said notch 2 of the barge 1. At the same time, the position of the connecting pins 11 is brought into line with the above-mentioned channels 5 by operating the pusher boat 3, and, immediately after this pre-positioning is finished, the hydraulic cylinders 15 are actuated to move outwards the connecting pins 11, whereby the convexities 13 and 14, with their fairly tapered ends, at the outboard end 12 of the connecting pin 11 will automatically select any one pair from among the pairs of concavities 7 and 9, 7′ and 9′, . . . , which is placed approximately at the same height as the connecting pin 11, and smoothly enter into it. After the outward movement of the connecting pin 11 is stopped, the pressure in said hydraulic cylinders 15 is kept as it is by a pump, a pressure accumulator or the like and, thus, the connection work between the barge 1 and the pusher boat 3 is completed as shown in FIG. 3.

When two watercraft are connected in the above-mentioned manner, no relative rotation between the barge and the connecting pins 11 is possible and relative rotations corresponding to the relative pitching between two watercraft is caused between the connecting pins 11 and the hull of the pusher boat 3. Therefore, in order to allow this relative motion, the inboard ends of said connecting pins 11 are connected to the force transmitting pieces 16 of the hydraulic power means such as hydraulic cylinders 15, respectively, by means of proper coupling members 17 which permit free relative rotational motions. Thereby, relative pitching of two watercraft can be permitted without causing any trouble or disorder. Further, the pairs of concavities are stepwise arranged vertically along the channels 5 over a necessary range corresponding to the range of variation of draft and the outboard ends 12 of the connecting pins 11 can automatically select and enter into, dependent on the existing draft relationship, any one pair of concavities which is placed approximately at the same height as the connecting pins 11. Therefore, draft adjustment is not necessary before connection by the connecting means of this invention.

As disclosed in the above explanations, the first embodiment of the present invention can connect the pusher boat and the barge without adjusting previously the draft relationship and assure excellent seaworthiness in a rough seaway through eliminating all relative motions other than relative pitching of two interconnected watercraft. For assuring such free relative pitching, however, each of pairs of concavities 7 and 9, 7′ and 9′, etc., must be in perfect alignment with the corresponding pair of concavities on the other side. And besides, no relative inclination is permitted when two watercraft are connected with each other. As the connecting means of this invention serves as a means of transmitting forces between two watercraft, the above-mentioned perfect alignment and extremely high geometrical accuracy is indispensable. Particularly in a combination of larger pusher boat and barge, such forces transmitted by the connecting means are so large as to cause damages to the connecting means if the above-mentioned perfect alignment and high geometrical accuracy can not be assured. In the actual building processes for barges and pusher boats which are constructed by electric arc welding, however, such perfect alignment and extremely high geometrical accuracy as are required above can hardly be realized. Also it is hardly possible to eliminate relative inclinations between two watercraft. Therefore, it is very desirable that a connecting means may have such a nature as to accommodate itself to above-mentioned inevitable misalignment and geometrical inaccuracy and realize a most reliable connection, and it is the reason why the second embodiment of the present invention is further proposed and explained hereinafter with particular reference to FIGS. 8 to 10. In the following descriptions relating to the second embodiment, same numerals may be used for items common to both first and second embodiments.

Figure 10:
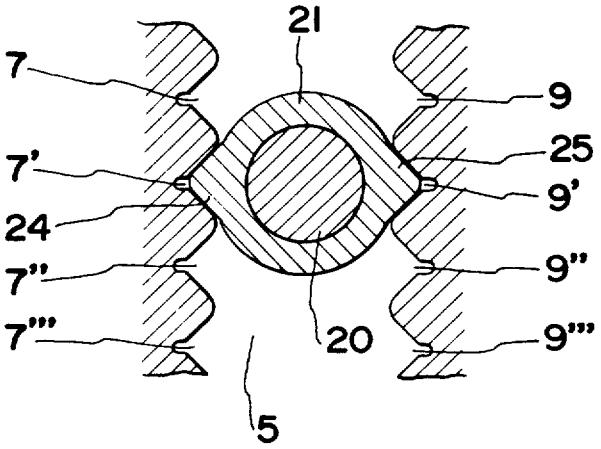
FIG. 10 is a vertical sectional view, taken along the line X — X in FIG. 8, of the outer end portion of the connecting pin and the channel of said embodiment.

In said figures, the connecting pin 18 contained in and supported by a bearing 10 provided on each side of the pusher boat 3 has an outboard end portion shaped as a spherical head 20 with a contracted neck portion 19, and a helmet 21 with spherical inside surface is mounted over said spherical head 20 so as to fit on the latter with least clearance. Said spherical inside surface is partly formed, in the opening portion where the spherical head portion of the connecting pin 18 enters therein, of a gland 22, which has an opening 23 of a diameter greater than that of said neck portion 19 and smaller than that of the spherical head 20 so that said helmet 21 can turn to any direction within the range limited by the correlation of diameters of said neck portion 19 and said opening 23. As is indicated in FIG. 10 showing cross-section, the helmet 21 has, on the forward and after sides of its outer surface, convexities 24 and 25, respectively, so shaped as to enter into any one of pairs of concavities 7 and 9, 7' and 9', etc., and come into tight contact therewith at the pre-determined depth. The outboard ends of these convexities 24 and 25 are fairly tapered in order to easily enter into the pair of said concavities. Besides, the helmet 21 is kept approximately in the horizontal position by a coil spring 28 provided between the end surface 27 of the connecting pin 18 and the back surface 26 of said helmet 21. Said helmet 21 and said convexities 24 and 25 thereon may preferably be so sized that they, as a whole, may be retracted into the bearing 10 when the connecting pin 18 is retracted by the action of the hydraulic cylinder 15.

Now, the functions and operations of the connecting means according to the second embodiment will be disclosed in the following.

Figure 8:
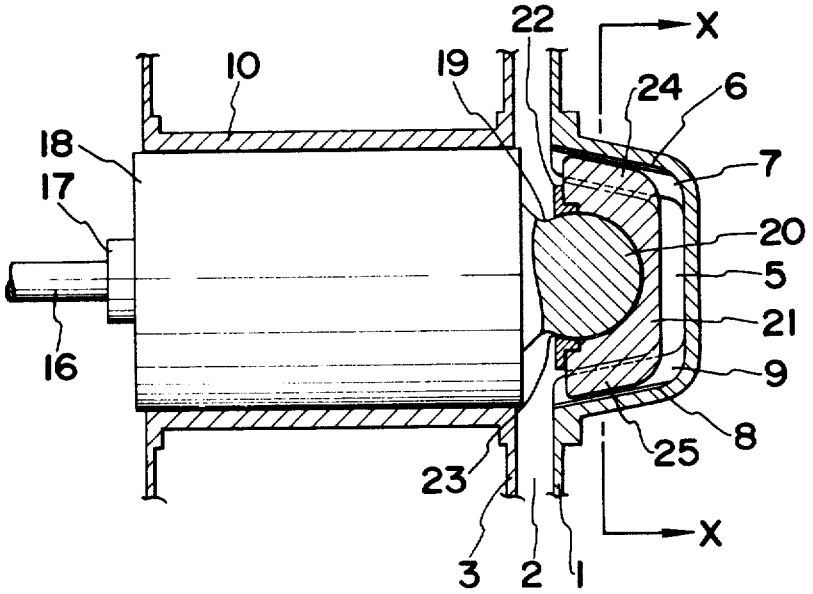
FIG. 8 is a schematic plan view of another embodiment of the present invention after connection.
Figure 9:
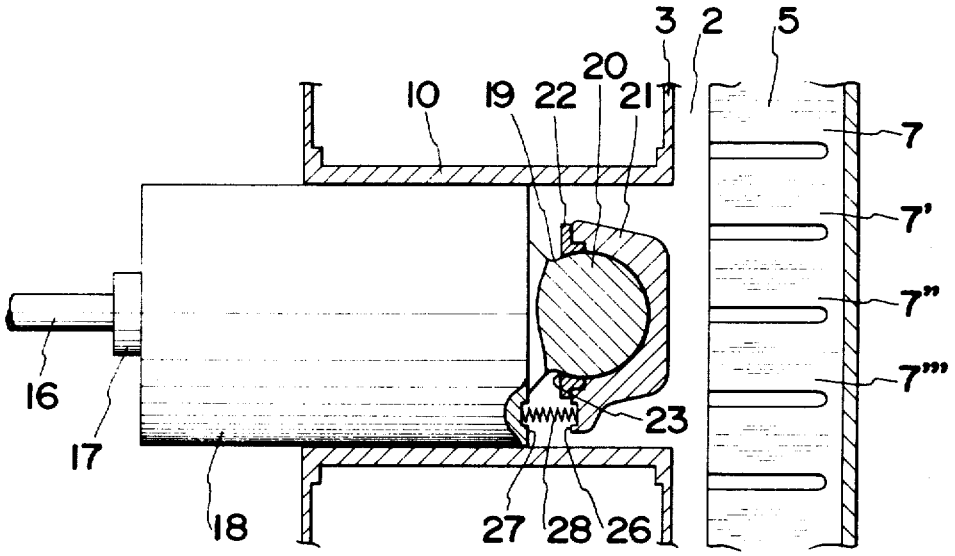
FIG. 9 is a vertical sectional view of said embodiment of FIG. 8 before connection.

Before connection, the connecting pin 18 contained in the bearing 10 is retracted into the hull of the pusher boat 3 as shown in FIG. 9. In this position, the connecting pin 21, together with the helmet 21 mounted on its outboard end, is entirely retracted into the hull of the pusher boat 3, so that the bow 4 of said pusher boat 3 can be easily inserted into said notch 2 of said barge 1. Then, the position of the connecting pins 18 is brought into line with the channels 5 and, at the same time, the helmets 21 are adjusted so that the convexities 24 and 25 may be approximately in a horizontal plane. Immediately after this preparation is finished, the hydraulic cylinders 15 are actuated to push out the connecting pins 18, whereby the convexities 24 and 25, with their fairly tapered ends, of the helmet 21 mounted at the outboard end of said connecting pin 18 will automatically select any one pair from among the pairs of concavities 7 and 9, 7' and 9', . . . , which is placed approximately at the same height as said connecting pin 18, and smoothly enter into it, whereby said helmet 21 will automatically adjust itself to any probable misalignment of said channel 5 and/or said pair of concavities thereof by turning itself around the spherical head 20 so that the convexities 24 and 25 may come into tight contact, without undue strain, with the surfaces of corresponding concavities. After the outward movement of the connecting pins 18 is stopped, the pressure in said hydraulic cylinders 15 is kept as it is by a pump, a pressure accumulator or the like and, thus, the connection work between the barge 1 and the pusher boat 3 is completed as shown in FIG. 8. Freely rotatable connection of the inboard ends of the connecting pins 18 and the ends of the force transmitting pieces 16 of the hydraulic cylinders 15 is similar to that of the first embodiment.

It is to be noted that the pusher boat and the barge can be effectively and reliably connected by using the connecting means of the present invention, which, in addition, can accommodate itself to any probable misalignment and/or geometrical inaccuracy inevitable in welded constructions, and also to slight relative inclinations between two watercraft, and the construction, characteristics and functions of this connecting means may be fully understood from the description of the embodiments in the above.

It should be emphasized, however, that the specific embodiments described and shown herein are intended as merely illustrative and in no way restrictive of the invention.

What is claimed is:

1. A means of connecting a pusher boat and a barge comprising:

a. a notch open rearwards, formed in the stern portion of said barge and sized and shaped to receive the bow portion of said pusher boat;

b. two vertically elongated channels formed within the wall of said notch, open toward said notch and facing each other transversely of the centerline of said barge;

c. concavities stepwise arranged from top to bottom on two side walls, opposite to each other and adjacent to said wall of said notch, of each of said channel in such a manner that any of said concavities on one of said side walls may have a corresponding concavity located at the same height on the other side wall, and horizontally elongated from the entrance to the bottom of said notch;

d. two transversely elongated connecting pins mounted on said bow portion of said pusher boat and having two convexities, shaped to correspond to and engage said concavities, on the foward and after sides of the outer end portion of each of said connecting pins;

e. pressure-fluid-operated actuating means for moving said connecting pins in respective, opposite directions between retracted positions outside said channels and inserted positions in said channels respectively while said bow portion is received in said notch.

2. A means of connecting a pusher boat and a barge as set forth in claim 1, wherein the outer end portion of each of said connecting pins is shaped as a spherical head with a contracted neck portion and a helmet with two convexities shaped to correspond to and engage said concavities on the forward and after sides thereof is rotatably mounted on said spherical head.

3. A means of connecting a pusher boat and a barge as set forth in claim 1, wherein said channels decrease in width away from said notch in a horizontal plane.

4. A means of connecting a pusher boat and a barge as set forth in claim 1, wherein said channels are of trapezial cross-section in a horizontal plane.

5. A means of connecting a pusher boat and a barge as set forth in claim 1, wherein each of said concavities is of triangular cross-section in a vertical plane.

6. A means of connecting a pusher boat and a barge as set forth in claim 1, wherein said actuating means can forcibly hold said connecting pins in inserted positions in said concavities so that said convexities may be kept in tight contact with said concavities.

* * * * *